United States Patent [19]

Dedels

[11] 3,994,766

[45] Nov. 30, 1976

[54] PIPE CLEANING AND WRAPPING MACHINE

[75] Inventor: Richard Lloyd Dedels, Edmonton, Canada

[73] Assignee: Proline Pipe Equipment Ltd., Edmonton, Canada

[22] Filed: July 18, 1973

[21] Appl. No.: 380,411

[52] U.S. Cl. ..... 156/392; 15/104.04; 118/72; 118/DIG. 11; 156/431; 156/577

[51] Int. Cl.[2] ..... B65H 81/08

[58] Field of Search ..... 156/392, 390, 430, 428, 156/431, 577; 15/88, 104.04; 118/72, 307, 208, DIG. 11

[56] References Cited

UNITED STATES PATENTS

| | | | |
|---|---|---|---|
| 2,253,848 | 8/1941 | Cummings | 156/392 |
| 2,344,264 | 3/1944 | Perrault | 15/104.04 |
| 2,471,580 | 5/1949 | Perrault et al. | 156/392 |
| 2,554,067 | 5/1951 | Smith | 118/307 |
| 2,791,198 | 5/1957 | Cummings | 156/392 |
| 3,050,759 | 8/1962 | Betzel | 15/104.04 |
| 3,117,401 | 1/1964 | Talley | 15/104.04 |
| 3,641,608 | 2/1972 | Kratt | 15/88 |

*Primary Examiner*—William A. Powell
*Assistant Examiner*—M. G. Wityshyn
*Attorney, Agent, or Firm*—James T. Wilbur; Arne I. Fors; Frank I. Piper

[57] ABSTRACT

The assembly is composed of a framework having a longitudinal passage for receipt of a pipe to be wrapped and a number of crawler wheels which contact the outer wall of the pipe and which cause the framework to move longitudinally relative to the pipe. The assembly also includes brushes and wrapping assemblies mounted to rings which circumscribe the pipe. Rotation of the rings causes the brushes to scour the pipe outer wall and tape to unwind from the wrapping assembly onto the pipe. Hydraulic motors are provided on the assembly for powering the crawler wheels, brushes and wrapping assemblies. The hydraulic motors are activated by hydraulic fluid pressurized by pumps located remote from the assembly.

2 Claims, 8 Drawing Figures

PIPE CLEANING AND WRAPPING MACHINE

This invention relates to a pipe cleaning and wrapping assembly and more particularly to a remote powered assembly which, as it travels along a pipeline, mechanically cleans the outerwall of the pipe by a system of brushes mounted for rotation about the pipe, thence wraps a protective tape spirally around the pipe. Provision may also be made for spraying a priming or coating solution onto the pipe outer wall after the cleaning operation and before the tape is wrapped on the pipe.

In pipeline construction where it is necessary to clean and wrap a continuous length of large diameter pipe it is conventional to employ three crawler tractors or like tracked vehicles which are each equipped with a side boom and which travel in single file along and beside the pipeline. A cradle is suspended from the side boom of each vehicle and these cradles support the pipeline at three locations when the cleaning and wrapping assembly is in operation. One cradle is located approximately 50 feet behind the assembly, one cradle 50 feet in front of the assembly and one cradle directly in front of it. The crawler tractor directly in front of the cleaning and wrapping assembly serves two purposes. It supports the pipe and the assembly and it stabilizes the assembly to prevent it from overturning.

Conventionally pipe cleaning and wrapping assemblies are provided with a top motor to power the cleaning and wrapping machines as well as the advance mechanism which propels the assembly along the pipeline. An operator is required to manipulate the various switches and levers which control the operation of the assembly and conventionally the operator stands on the side of the cleaning and wrapping assembly adjacent the supporting crawler tractor.

Such a pipe cleaning and wrapping assembly has some very serious shortcomings. Assemblies capable of handling large pipes e.g. 36 to 48 inches in diameter, are so high that they cannot travel under many overpasses on main highways. For example, the height of underpasses on main highways across Canada is as low as 17 ½ feet and the height of such assemblies when set on a so-called "high-boy" trailer exceeds this value. Another serious shortcoming of conventional assemblies is the danger to which the operator is exposed the assembly is in operation. In several instances, operators have been seriously injured where the weight of the crawler tractor caused the ditch into which the wrapped pipe is lowered to cave in with resulting upsetting of the cleaning and wrapping assembly. The operators did not have sufficient time or room to escape being crushed by the assembly.

The cleaning and wrapping assembly of the present invention shares none of the above discussed shortcomings. The subject assembly is provided with a number of hydraulic motors and actuators which serve as prime movers for all the operations carried out by the device. Pressurized fluid for actuating the motors is generated by hydraulic pumps and an engine located on the crawler tractor and not on top of the cleaning and wrapping assembly. By locating the hydraulic pump and engine remote from the cleaning and wrapping assembly, the total weight of the assembly is substantially less than an assembly having a top mounted pump and engine and capable of handling the same sized pipe. For example, it is estimated that an assembly capable of cleaning and wrapping a 48 inch diameter pipe and constructed in accordance with the subject invention will weigh approximately 2,000 pounds less than a conventional assembly capable of performing the same operation. Furthermore of course, there is a significant cost savings since the subject assembly is powered by the same engine that powers the crawler tractor and not by a separate engine as is the conventional cleaning and wrapping assembly.

A further advantage of the subject assembly is that its vertical height is significantly less than that of conventional cleaning and wrapping assemblies capable of handling the same sized pipes since there is no need for a top mounted motor. Moreover, since the space on top of the assembly is free of a noisy, hot and polluting engine, the operator's chair and controls may safely be located there. In such location, the operator is in a favourable position to escape injury should the assembly upset. He is also in a better location to observe the cleaning and wrapping operation.

The assembly of the invention possesses still further advantages over conventional wrapping and cleaning devices. Cleaning of the pipe outer surface is accomplished according to the present invention by brushes curved to the shape of the outer wall and mounted on rings mounted for rotation about the circumference of the pipe. The brushes are out of contact with the pipe when the rings are stationary but as the rings begin to revolve the brushes are urged by centrifugal force into contact with the outside wall of the pipe. The pressure exerted by the brushes against the pipe may be easily regulated by appropriate adjustment of the rate of revolution of the rings.

Brushes of conventional assemblies are similarly mounted but they are flat and are spring loaded so that they apply pressure to the pipe outer wall at all time. Because of the spring loading, significantly more power is required to start the conventional brushes in motion than the brushes of the subject invention.

The assembly of the invention is also provided with a novel brake for adjusting the braking force applied to the spool of wrapping tape. The brake causes the tension of the wrapping tape to remain constant as the radius of the tape roll decreases.

Broadly, the assembly of the invention comprises a framework having a longitudinal passage for receipt of a pipe to be wrapped; a plurality of crawler wheels positioned on the framework for contact with the outer wall of the pipe, the crawler wheels, upon rotation thereof, causing the framework to move longitudinally relative to the pipe; cleaning means and wrapping means both mounted on the framework and adapted to contact the outer pipe wall for cleaning and wrapping respectively of the pipe as the framework moves along the pipe; hydraulic motor means mounted on the framework for activating the cleaning and wrapping means; hydraulic fluid pressurizing means located remote from the framework; and conduit means for transferring pressurized hydraulic fluid from the pressurizing means to the hydraulic motor means for activation thereof.

The invention is described in detail with reference to the drawings in which.

Like reference characters refer to like parts throughout the description of the drawings.

Figure 1:
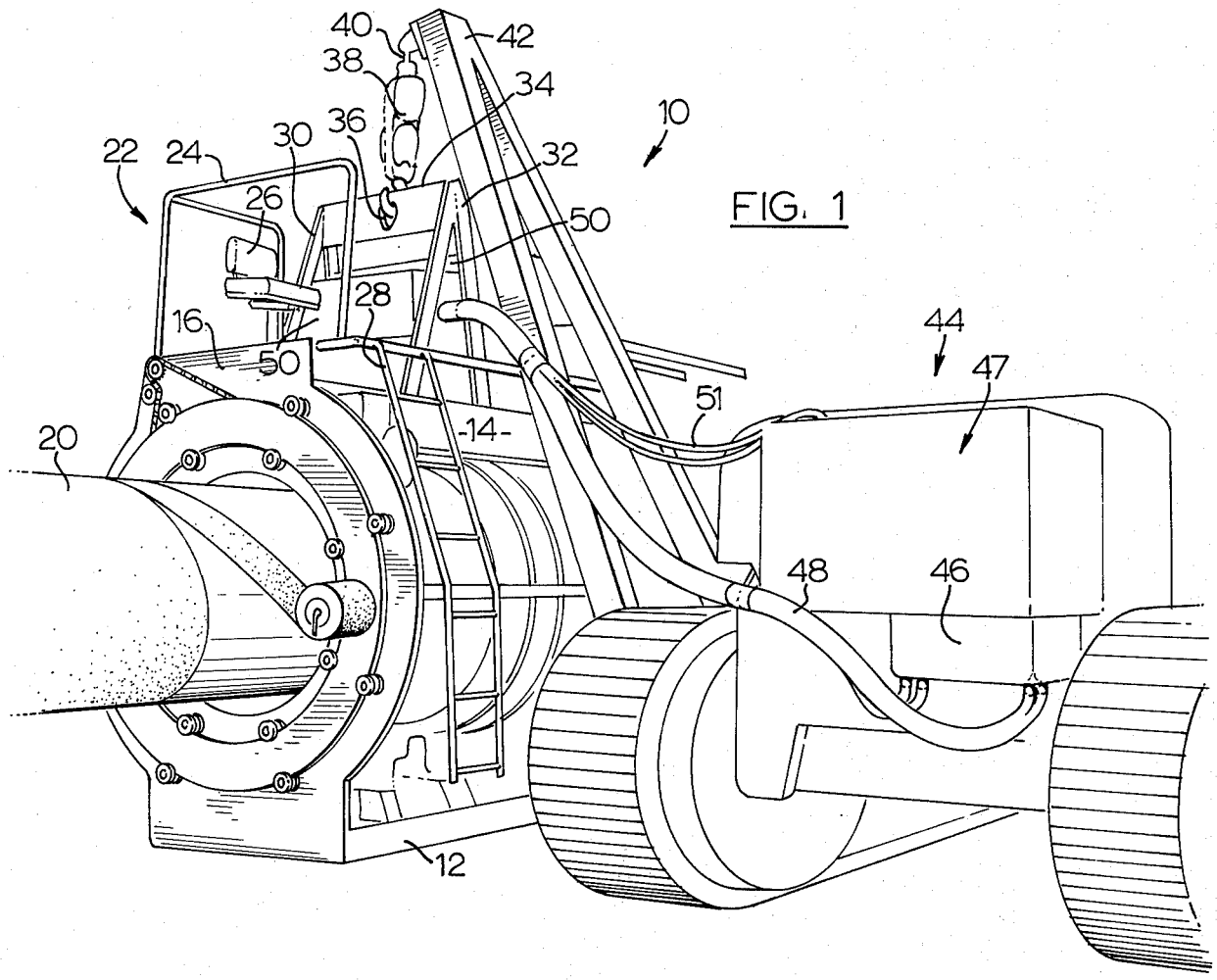
FIG. 1 is a perspective view of the assembly of the invention mounted upon a section of a pipeline and supported and activated by a crawler tractor.

With reference to FIG. 1, the assembly of the invention comprises a framework indicated generally 10 made up of spaced apart lower and upper frame elements 12, 14, a generally circular rear frame element 16 and a front frame element (FIG. 4) made up of spaced upstanding bars 18*a*, 18*b*. The assembly is mounted upon pipe section 20.

A super-structure generally 22 extends above upper frame element 14. The super-structure comprises a guardrail 24 which extends along the rear and one side wall of the machine and an operator's chair 26. A ladder 28 extends downwardly from the super-structure. A pair of V-shaped uprights 30, 32 extend upwardly from each side of the upper frame element 14 and terminate at a cross beam 34 provided with a central opening 36 for accommodation of a hook assembly 38. The hook assembly is attached to cable 40 which is trained over a roller (not illustrated) at the upper end of a boom 42 and is wound upon a drum mounted within a tracked vehicle indicated generally by the numeral 44.

The engine of the tracked vehicle is in driving relationship with hydraulic pumps mounted within housing 46. The pumps pressurize hydraulic fluid flowing from reservoir 47 and the pressurized fluid passes through conduits 48 to a central valve junction mounted within a control panel 50 adjacent the operator's chair 26. Fluid returning to the tracked vehicle passes through return conduits 51. Means is provided on the panel for manually controlling the flow of fluid to the various hydraulic motors and actuators described below. It should be noted that the assembly of the invention is activated wholly by pressurized fluid generated by the pumps connected to the tracked vehicle.

ASSEMBLY ADVANCE MECHANISM

Figure 3:
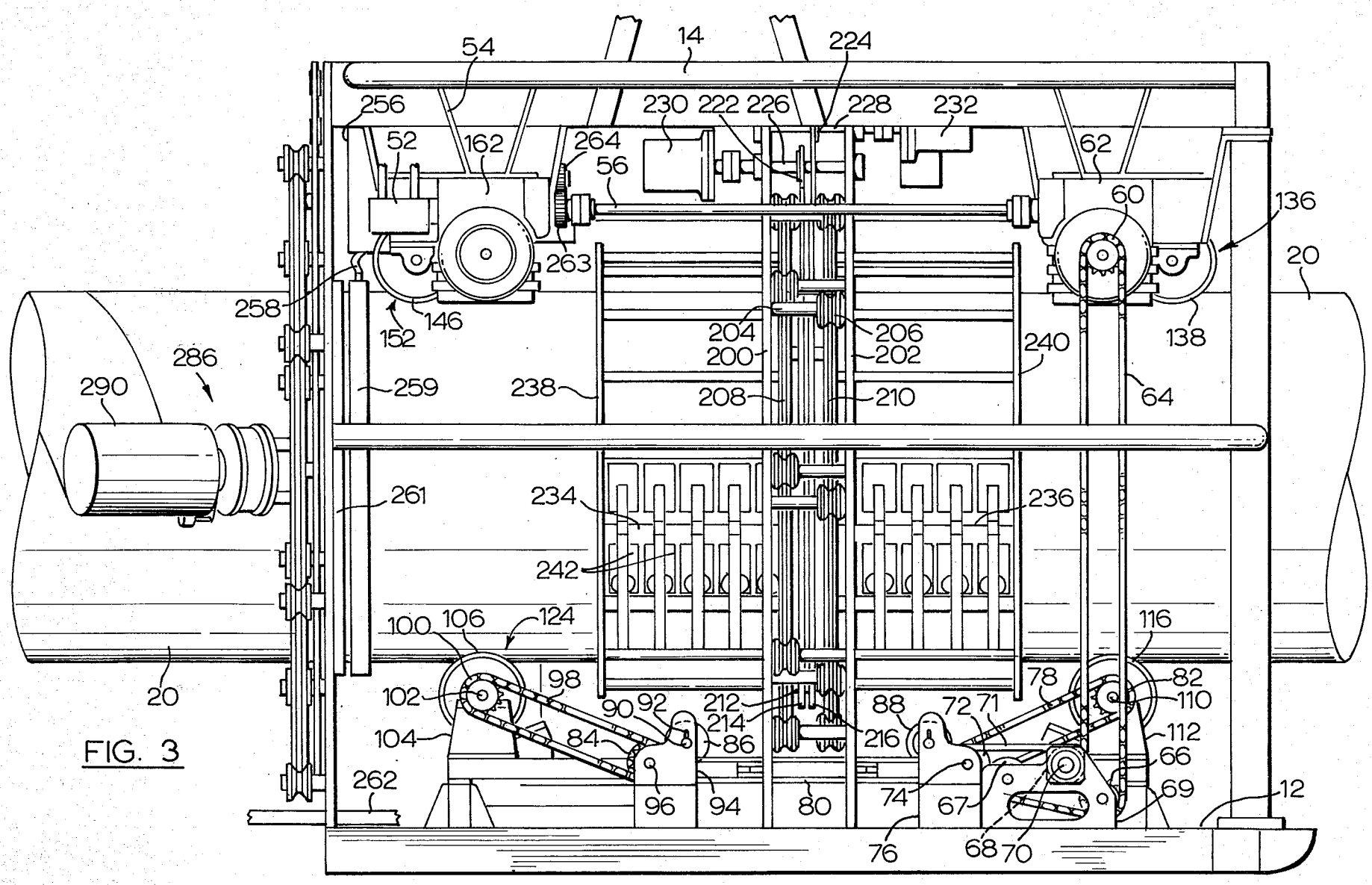
FIG. 3 is a partly schematic side elevation of the assembly mounted upon a pipe section.

With reference to FIG. 3, hydraulic motor 52 is bolted to a frame 54 which projects downwardly from the underside of the upper frame element 14. The motor drives shaft 56 which imparts rotation to a sprocket 60 via a speed reducer 62 fastened to the underside of the upper frame element. Sprocket 60 has trained over it a roller chain 64 which is trained about and imparts rotation to a lower forward sprocket 66, a lower adjustable chain-tightening sprocket 67 and a third lower sprocket 68 (in dashed line). All three sprockets 66, 67, 68 are journaled in a lower support structure 69 which is bolted or otherwise attached to lower frame element 12.

Sprocket 68 is keyed to axle 70 and a second sprocket (positioned behind and hidden by sprocket 68) is also keyed to axle 70 to rotate with sprocket 68. The said second sprocket drives a chain 71 which is trained about sprocket 72 keyed to shaft 74 journaled on upstanding forward bracket 76 mounted to the upper surface of the lower frame element.

Two other sprockets (hidden behind sprocket 72) are keyed to shaft 74. Separate roller chains 78, 80 are trained about each sprocket. Chain 78 is trained about lower forward crawler drive sprocket 82 while chain 80 is trained about lower rear sprocket 84. Chain 80 is also trained about a pair of chain-tightening sprockets 86, 88. Sprocket 86 is keyed to a shaft 90 which is journaled in an elongated slot-shaped opening 92 formed in each of a pair of upstanding spaced apart limbs of bracket 94. Shaft 90 is held in any desired position by suitable means such as by nuts tightened on the threaded end portions of the shaft. By appropriate adjustment of the position of shaft 90 and by a shaft to which sprocket 88 is keyed, of the same construction as shaft 90, the chain 80 can be maintained taut at whatever may be the horizontal spacing of forward and rear brackets 76, 94 respectively.

Figure 4:
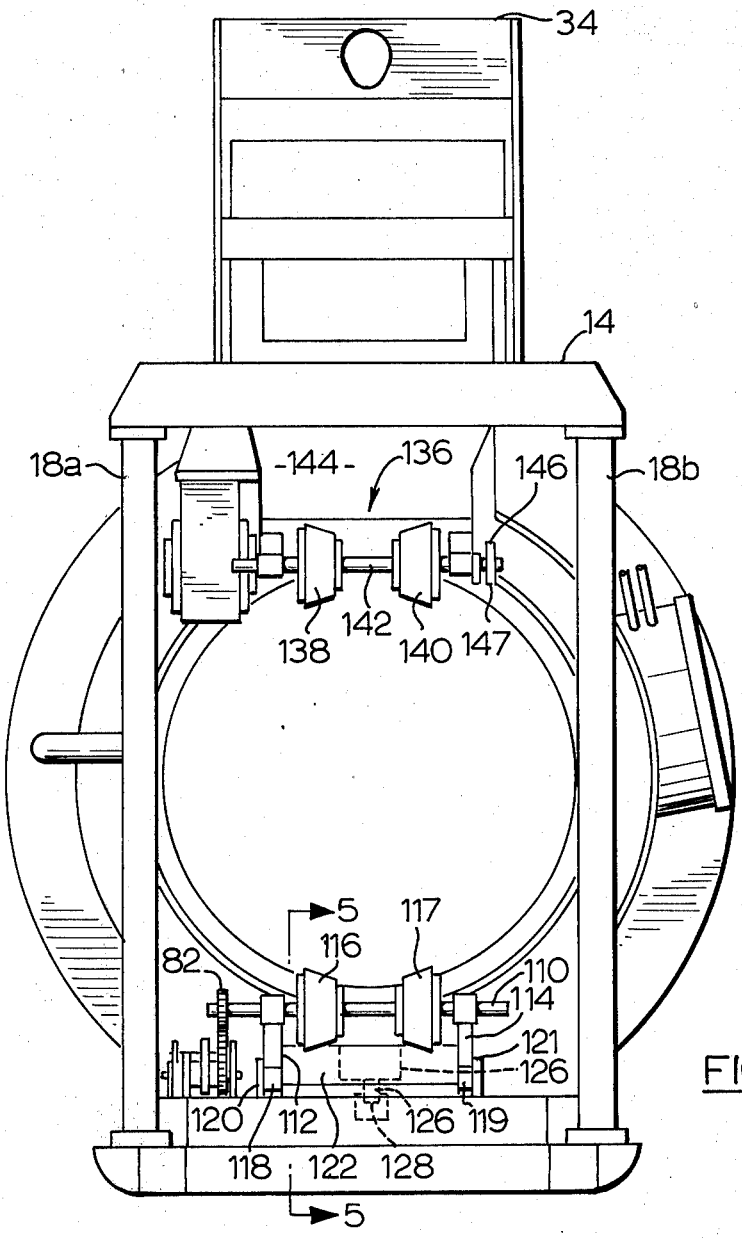
FIG. 4 is a front elevation of the assembly.

A second sprocket (not illustrated) is keyed to shaft 96 to which sprocket 84 is keyed. A chain 98 is trained about the former sprocket and about lower rear crawler drive sprocket 100. Sprocket 100 is keyed to axle 102 which is journaled in a pair of spaced apart upstanding supports (one of which being illustrated and indicated 104). Also keyed to the axle is a pair of spaced apart lower rear crawler wheels 106, 108 (FIG. 6) which are bevelled to conform approximately to the shape of the outside wall of pipe section 20 seated thereon. In like manner, the lower front crawler drive sprocket 82 is keyed to axle 110 which is journaled in a pair of spaced supports 112, 114 (FIG. 4). A pair of lower forward crawler wheels 116, 117 of the same construction as wheels 106, 108 is keyed to axle 110.

Figure 5:
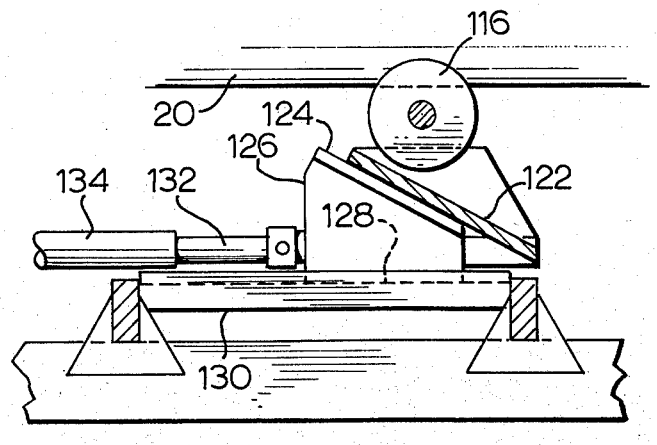
FIG. 5 is a view on line 5—5 of FIG. 4.
Figure 6:
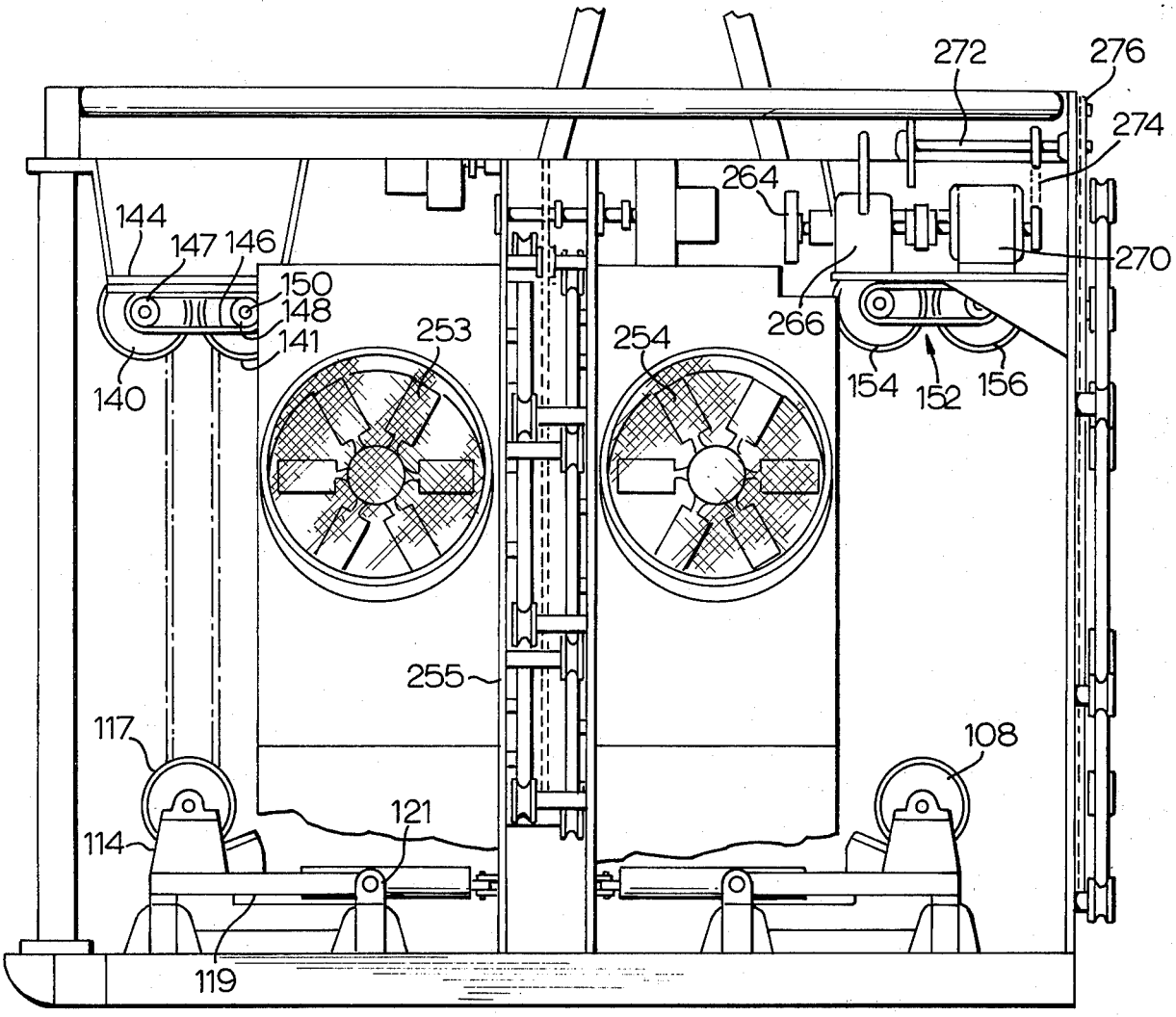
FIG. 6 is an elevation of a side of the assembly opposite that shown in FIG. 3.

Provision is made for raising and lowering the lower crawler wheels 106, 108, 116, 117 to provide sufficient clearance for easy mounting of the assembly onto a pipeline section. Also, pipe sections of various diameter can be accommodated by adjusting the distance between the crawler wheels mounted to each axle and by changing the elevation of the lower crawler wheels. The means by which the elevation of the crawler wheels may be changed is illustrated in FIGS. 4 to 6. Supports 112, 114 are mounted upon the ends of arms 118, 119 respectively and the other ends of the arms are pivotally connected to lugs 120, 121 respectively anchored to lower frame element 12. The arms permit pivoting of axle 110 about the pivotal connections of arms 118, 119 in such a way that chain 78 (FIG. 3) always remains taut.

Axle 110 is journaled in bearings mounted on supports 112, 114 which are positoned outside crawler wheels 116, 117. A plate 122 is attached to and extends between supports 112, 114 and it inclines downwardly toward the front end of the assembly. The plate rests upon the upper wall 124 of a wedge which wall also is inclined downwardly toward the front end of the assembly. The wedge is generally "T" shaped in section and has a web 126 which depends downwardly from the upper wall and which is accommodated within a longitudinal slot 128 formed in a guide bar 130 anchored to the lower frame element. The wedge is connected by suitable means to a piston rod 132 and the rod is driven by actuator 134. Activation of the actuator causes wedge 126 to move horizontally and longitudinally of the assembly i.e. parallel to the axis of pipe section 20. By so moving the wedge causes plate 122 and also crawler wheels 116, 117 to move vertically. This vertical movement allows sufficient clearance for easy mounting of the assembly to new sections of pipe.

In like manner, the elevation of lower rear crawler wheels 106, 108 can also be adjusted.

The upper drive structure at the forward end of the assembly indicated generally 136 in FIGS. 3, 4 and 6 consists of two pairs of spaced apart upper crawler wheels which contact the top wall of the forward portion of pipe section 20. The forward pair of crawler wheels is marked 138, 140 in FIG. 4 and one of the rear pair is marked 141 in FIG. 6. The forward pair 138, 140 is keyed to axle 142 which is journaled in downwardly projecting limbs of bracket 144, the bracket being secured to the upper frame element 14 by suitable means. A roller chain 146 (FIG. 6) meshes with sprockets 147 keyed to an end of axle 142 and also a sprocket 148 keyed to the end of axle 150 to which is keyed rear wheels 141. A second sprocket (not shown) is keyed to the end of axle 150 opposite sprocket 148 and the second sprocket is driven by speed reducer 62 (FIG. 3). Axle 150 is also journaled in bracket 144 and is disposed parallel to axle 142 and is spaced longitudinally apart therefrom.

The upper drive structure at the rear end of the assembly, indicated generally 152, has the same structure as upper drive structure 136 at the forward end of the assembly. The drive structure comprises two pairs of crawler wheels (one of each pair illustrated in FIG. 6 and numbered 154, 156). Rotation is imparted to the crawlers by speed reducter 162 (FIG. 3) by a suitable gear linkage. Speed reducer 162 is driven by motor 52.

Hydraulic motor 52 serves as a prime remover for all the crawler wheels. The speed reducers and gear linkages operatively interconnecting all the crawler wheels and motor 52 are constructed to cause all the wheels to turn at the same rate. As a result, each crawler wheel moves the assembly at the same rate along the pipe as the remaining crawler wheels whatever may be the rate of rotation of motor 52. The assembly will therefore not jam as a result of differing rates of rotation of the various crawler wheels.

BRUSHING ASSEMBLY

With reference to FIG. 3, a pair of spaced apart yokes 200, 202 extend between upper and lower frame elements 14, 12 and circumscribe the pipe to be wrapped. A plurality of horizontally disposed roller shafts 204 are connected to and extend between the yokes. The shafts are spaced along the lengths of the yokes and a grooved roller 206 is mounted for rotation on each shaft. The grooves of the rollers are arranged to rotatably support two parallel annular cleaning heads 208, 210.

A number of rods 212 are secured to facing surfaces of each cleaning head 208, 210. The rods are spaced inwardly of the circumference of the heads and terminate at a pair of spaced parallel ring-type sprockets 214, 216. Drive chains are trained around sprockets 214, 216 and around upper drive sprockets 222, 224 respectively. The latter drive sprockets are keyed to shafts 226, 228 each journaled in yokes 200, 202. The shafts are driven by hydraulic motors 230, 232 fastened to upper frame element 14.

A number of brush-securing rods 234, 236 are connected to and extend outwardly from the opposite-facing surfaces of cleaning heads 208, 210 respectively. The rods are spaced inwardly of and along the circumference of the heads and terminate in outer support rings 238, 240 respectively.

Figure 7:
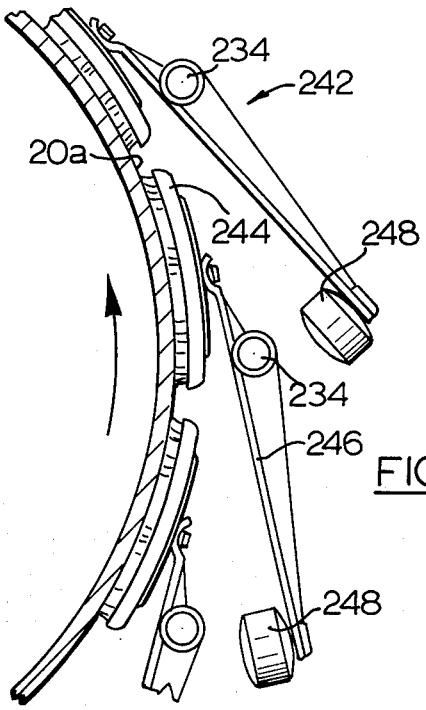
FIG. 7 is an elevation of the brushing assembly incorporated in the assembly of the present invention.

A plurality of brush assemblies 242 are spaced along the lengths of ach rod 234, 236. As seen in FIG. 7, each brush assembly is composed of a head 244 curved to conform to the shape of the pipe external wall 20*a*. The radius is connected to one end of an arm 246 pivotally connected to rod 234. A counterweight 248 having a weight greater than the brush head is connected to the other end of arm 246.

Cleaning of the pipe external surface is accomplished by activation of hydraulic motors 230, 232 which impart rotation to cleaning heads 208, 210 and to rods 234, 236. As the rate of rotation of rods 234, 236 about the pipe increases, the centrifugal force acting on counterweights 248 increases with resulting increase in the pressure applied by the brush heads 244 on the pipe. The inward pressure applied to the pipe by the brush heads 244 can of course be varied by changing the rate of rotation of cleaning heads 208, 210.

Foreign particles and other material removed from the outer wall of the pipe is carried outwardly of the machine by means of longitudinally spaced faces 253, 254 (FIG. 6) mounted in guard plate 255 disposed radially outwardly of the brushes. Hydraulic motors, (not illustrated) activate the fans.

PIPE PRIMING AND WRAPPING ASSEMBLY

Figure 2:
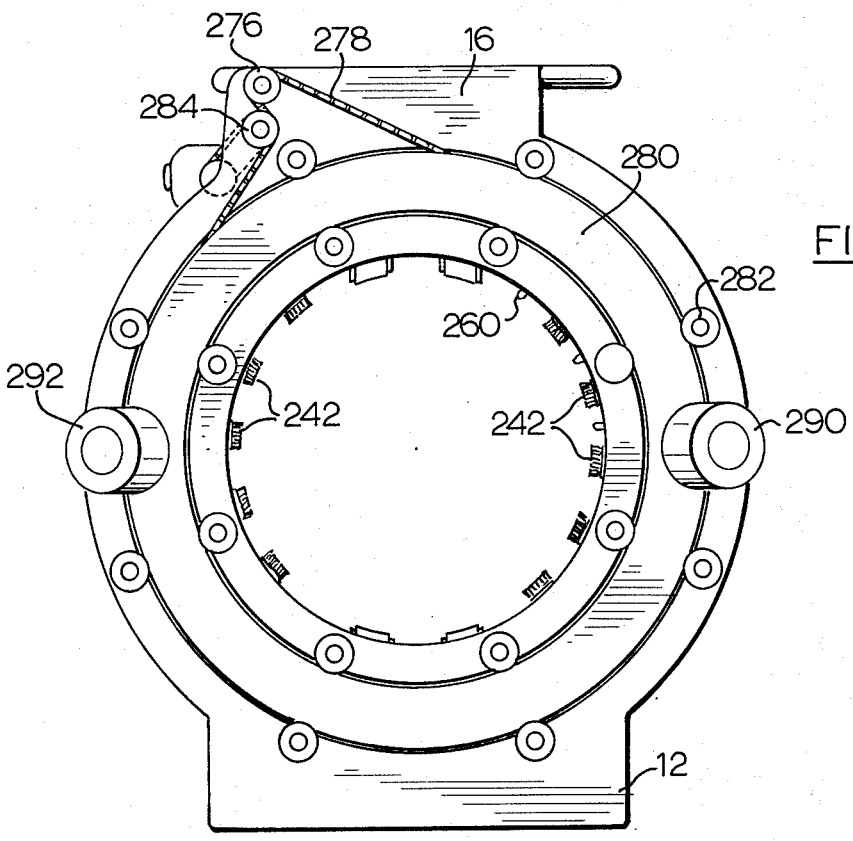
FIG. 2 is a rear elevation of the assembly.

With reference again to FIG. 3, a tank 256 containing a supply of coating material is secured to the upper frame element 14 rearwardly of hydraulic motor 230. Coating material is fed by means of a hydraulic pump (not illustrated) through a conduit 258 into a hollow ring 259 which encompasses the pipe section. The rings is provided along its inner wall with a plurality of orifices 260 (several of which are shown in FIG. 2) through which the coating liquid passes. The liquid emerges from the orifices in the form of a spray and coats the pipe outer wall. The liquid is smoothed by means of a conventional smoothing collar 261 mounted aft of hollow ring 259.

A catch basin 262 is mounted beneath ring 259 and collar 261. Excess coating liquid is collected in the basin and is recirculated to tank 256 by means of a hydraulic pump (not illustrated).

With reference to FIGS. 2, 3 and 6, a driving spur gear 263 (FIG. 3) is keyed to shaft 56 and gear 263 engages a driven spur gear 264 which imparts rotation to transmission 266 (FIG. 6). Transmission in turn activates a variable speed reducer 270 which powers a shaft 272 via roller chain 274. A drive sprocket 276 is keyed to the end of shaft 272 and trained over the latter sprocket is a drive chain 278 (FIG. 2) which imparts rotation to a comparatively larger driven sprocket 280 which is of the ring-type design to permit passage of the pipe to be wrapped through its centre. The ring sprocket 280 is rotatably supported on a plurality of circularly spaced rollers 282 which are suitably carried on the machine structure.

A suitably adjustable chain-tightening sprocket 284 is also supported on the machine structure as shown.

A pair of wrapping assemblies (one illustrated in FIG. 3 and numbered generally 286) extend outwardly from diametrically opposite portions of the rear face of sprocket 280. The assemblies include tape spools 290, 292 which are rotatably mounted at the proper angles to the pipeline for helically unwinding the tape from the spools upon the pipeline in lapped position. The two wrapping assemblies have the same construction and the construction of assembly 286 is illustrated in FIG. 8.

Figure 8:
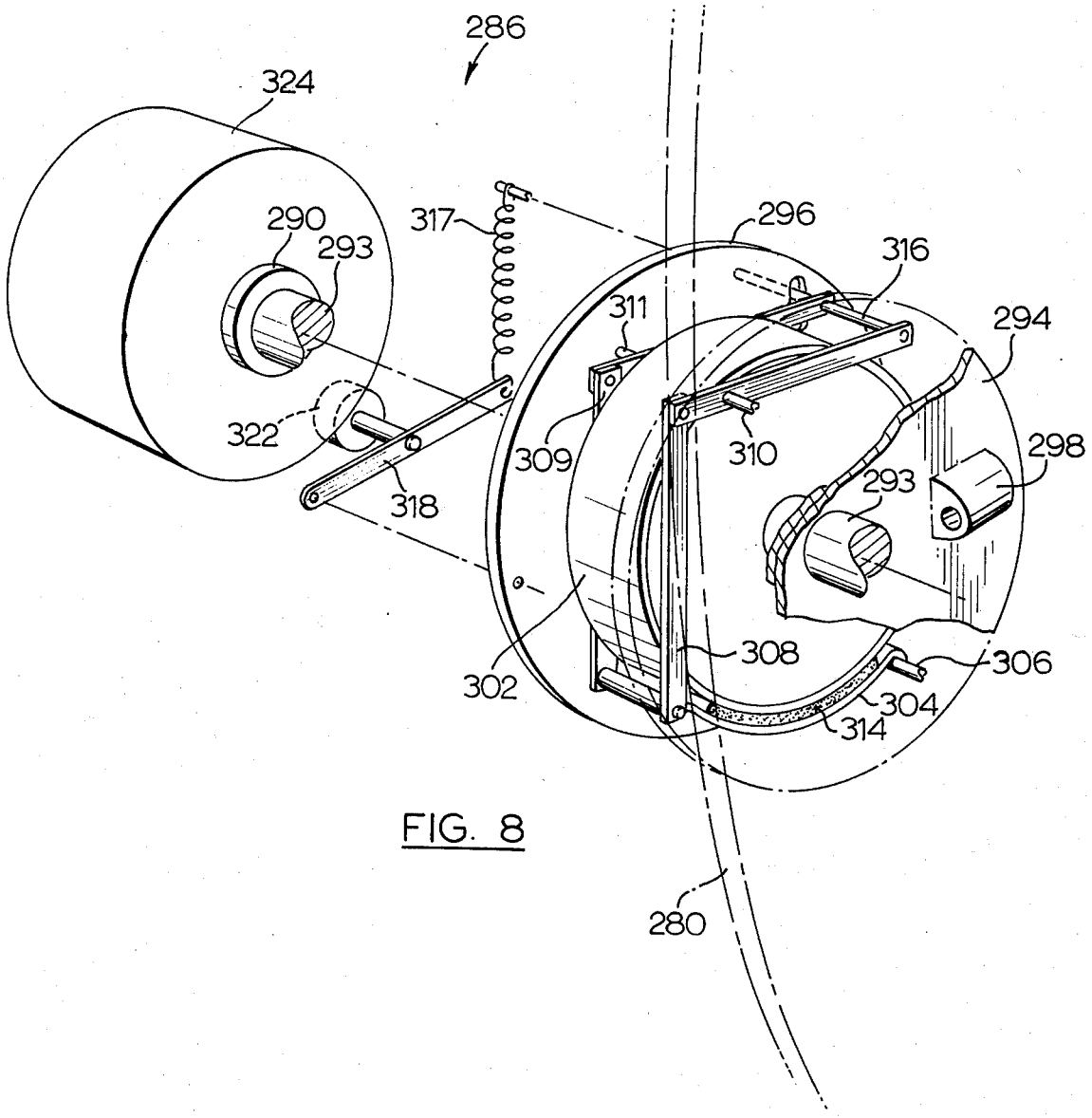
FIG. 8 is an exploded perspective view of the pipe wrapping assembly incorporated in the subject assembly.

With reference to FIG. 8, wrapping assembly 286 includes a spindle 293 which is journaled in inner and outer cover plates 294, 296. A pair of lugs 298 project from inner plate 294 to facilitate attachment thereof to ring sprocket 280. The cover plates are held rigidly in a spaced apart relationship by suitable means such as by connecting pins (not shown).

A circular brake drum 302 is keyed to spindle 293 and is mounted for rotation in the space between cover plates 294, 296. An arcuate brake band 304 is mounted adjacent the outer wall of the brakedrum. One end of the brake band is pivotally connected at one end 306 to cover plates 294, 296 and the other end is connected to one end of a pair of parallel L-shaped brake linkages 308, 309 which are disposed on opposite sides of the brake drum and which are pivotally mounted at 310, 311 to cover plates 294, 296 respectively. The brake band is provided with a lining 314 in the surface facing the outer wall of brake drum 302.

The other ends of brake linkages 308, 309 are interconnected by rod 316 which extends through an aperture in cover plate 296 and connects with a tension spring 317. The spring is also connected to one end of a sensing arm 318 and the other end of the arm is pivotally connected to cover plate 296. A sensing head 322 is fixed to the arm and is biased into contact with the roll of tape 324 by tension spring 317.

In operation, the braking pressure applied by the brake lining to brake drum 302 is regulated by the size of the roll of tape 324. As the radius of the roll decreases, the force exterted by spring 326 on the brake drum 304 lessens and therefore the braking pressure decreases. By means of the instant braking assembly, the tension of the wrapping tape remains constant as the radius of the roll decreases.

It will be understood of course, that modifications can be made in the preferred embodiment of the present invention as described hereinabove without departing from the scope and purview of the invention as defined in the appended claims.

What I claim as new and desire to protect by Letters Patent of the United States is:

1. A pipe-cleaning and wrapping assembly comprising: a framework having a longitudinal passage for receipt of a pipe to be wrapped; a plurality of wheels positioned on the framework for contact with the outer wall of said pipe, said wheels, upon rotation thereof, causing said framework to move longitudinally relative to said pipe, certain of said wheels being arranged in pairs positioned to contact a lower wall of said pipe, said wheel pairs each being interconnected by an axle; cleaning means and wrapping means both mounted on said framework and adapted to contact said outer pipe wall for cleaning and wrapping respectively of said pipe as the framework moves along the pipe; hydraulic motor means mounted on said framework for activating said wheels and said cleaning and wrapping means; hydraulic fluid pressurizing means located remote from said assembly; conduit means for transferring pressurized hydraulic fluid from said pressurizing means to said hydraulic motor means for activation thereof; a plurality of arm means, a first said arm means being rotatably connected at one end to a respective said axle and a second said arm means being pivotally connected to said framework at the other end thereof, a plate connected to and extending between said arm means and having a downwardly sloping lower surface; a wedge positioned beneath each said plate and having a downwardly sloping upper surface in contact with said plate lower surface; a hydraulically operative actuator connected to said framework and having piston rods connected to each said wedge, said acutator adapted to move said wedges longitudinally relative to said pipe with resulting change in elevation of said plate and said wheel pairs.

2. A pipe-cleaning and wrapping assembly comprising: a framework having a longitudinal passage for receipt of a pipe to be wrapped; a plurality of wheels positioned on the framework for contact with the outer wall of said pipe, said wheels, upon rotation thereof, causing said framework to move longitudinally relative to said pipe; cleaning means and wrapping means both mounted on said framework and adapted to contact said outer pipe wall for cleaning and wrapping respectively of said pipe as the framework moves along the pipe; hydraulic motor means mounted on said framework for activating said wheels and said cleaning and wrapping means; hydraulic fluid pressurizing means located remote from said assembly; and conduit means for transferring pressurized hydraulic fluid from said pressurizing means to said hydraulic motor means for activation thereof, said wrapping means including: a ring circumscribing said pipe and adapted to revolve thereabout; a spindle rotatable relative to said ring and having means for receipt of a roll of tape and further having a brake drum connected thereto; a brake lining positioned adjacent said brake drum and pivotally connected relative to said ring; a member connected to and spaced from said ring; a sensing arm having a sensing head attached thereto and pivotally connected to said member; resilient means interconnecting said sensing arm and said brake lining for biasing said sensing head into contact with said tape roll such that as the diameter of said tape roll diminishes the pressure exerted by said lining on said brake drum decreases.

* * * * *